US010619517B2

(12) United States Patent
Quennehen et al.

(10) Patent No.: US 10,619,517 B2
(45) Date of Patent: Apr. 14, 2020

(54) TURBINE RING ASSEMBLY

(71) Applicant: SAFRAN AIRCRAFT ENGINES, Paris (FR)

(72) Inventors: Lucien Henri Jacques Quennehen, Paris (FR); Sébastien Serge Francis Congratel, La Brosse Montceaux (FR); Clément Jean Pierre Duffau, Paris (FR); Nicolas Paul Tableau, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 287 days.

(21) Appl. No.: 15/680,934

(22) Filed: Aug. 18, 2017

(65) Prior Publication Data

US 2018/0051591 A1 Feb. 22, 2018

(30) Foreign Application Priority Data

Aug. 19, 2016 (FR) ..... 16 57826

(51) Int. Cl.
*F01D 25/28* (2006.01)
*F01D 25/24* (2006.01)
(Continued)

(52) U.S. Cl.
CPC ..... *F01D 25/28* (2013.01); *F01D 11/005* (2013.01); *F01D 11/08* (2013.01); *F01D 25/246* (2013.01);
(Continued)

(58) Field of Classification Search
CPC ..... F01D 25/28; F01D 11/005; F01D 11/08; F01D 25/246; F01D 11/24; F01D 25/12;
(Continued)

(56) References Cited

U.S. PATENT DOCUMENTS 4,596,116 A * 6/1986 Mandet ..... F01D 11/08 415/173.2
5,188,506 A * 2/1993 Creevy ..... F01D 11/005 277/643
(Continued)

FOREIGN PATENT DOCUMENTS

CA 2986285 A1 * 8/2018 ..... F01D 25/246
EP 1350927 A2 10/2003
(Continued)

OTHER PUBLICATIONS

Search Report dated May 16, 2017, in French Application No. 1657826 (2 pages).

*Primary Examiner* — J. Todd Newton
(74) *Attorney, Agent, or Firm* — Bookoff McAndrews, PLLC

(57) ABSTRACT

A turbine ring assembly includes ring sectors made of ceramic matrix composite forming a ring and a ring support structure. Each sector includes an annular base with, in a radial direction, an inside face and an outside face from which extend two attachment tabs held between two radial tabs of the structure. The assembly also includes, for each sector, at least two pins cooperating with one of the attachment tabs and the corresponding radial tab, and at least one pin cooperating with the other attachment tab and the corresponding radial tab. The first radial tab includes a first annular radial portion integral to the structure, and a removable second annular radial portion extending radially toward the center of the ring over a greater portion than said first radial annular portion, the portion extending beyond the first annular radial portion including orifices for receiving one of the pins.

9 Claims, 3 Drawing Sheets

(51) Int. Cl.
*F01D 11/00* (2006.01)
*F01D 11/08* (2006.01)

(52) U.S. Cl.
CPC ..... *F05D 2220/32* (2013.01); *F05D 2240/11* (2013.01); *F05D 2260/30* (2013.01); *F05D 2300/6033* (2013.01)

(58) Field of Classification Search
CPC ..... F05D 2220/32; F05D 2240/11; F05D 2260/30; F05D 2300/6033; F05D 2230/64; F05D 2230/642; F05D 2230/644; F05D 2250/75; F05D 2260/221; F05D 2230/5021
USPC ..... 415/173.1
See application file for complete search history.

(56) References Cited

U.S. PATENT DOCUMENTS 5,988,975 A * 11/1999 Pizzi ..... F01D 11/005 415/139
7,374,395 B2 * 5/2008 Durocher ..... F01D 9/04 415/115
8,790,067 B2 * 7/2014 McCaffrey ..... F01D 11/18 415/1
10,487,689 B2 * 11/2019 Bonneau ..... F01D 25/24
2004/0047726 A1 * 3/2004 Morrison ..... F01D 9/04 415/116
2006/0292001 A1 * 12/2006 Keller ..... F01D 11/025 415/170.1
2007/0077141 A1 * 4/2007 Keller ..... F01D 11/08 415/136
2008/0178465 A1 7/2008 Schiavo et al.
2011/0182724 A1 * 7/2011 Koyabu ..... F01D 9/04 415/180
2012/0027572 A1 2/2012 Denece et al.
2012/0082540 A1 4/2012 Dziech et al.
2013/0156550 A1 * 6/2013 Franks ..... F01D 11/08 415/126
2014/0271145 A1 9/2014 Thomas et al.
2015/0226124 A1 * 8/2015 Tsutsumi ..... F01D 25/246 415/193
2015/0377069 A1 * 12/2015 Landwehr ..... F01D 25/28 415/1
2016/0169025 A1 * 6/2016 Lamusga ..... F01D 11/08 415/173.1
2016/0319686 A1 * 11/2016 Shi ..... F23R 3/007
2016/0341055 A1 * 11/2016 Jenkins ..... F01D 11/001
2017/0101882 A1 * 4/2017 Sippel ..... F01D 11/08
2017/0298776 A1 * 10/2017 Rogers ..... F01D 11/08
2018/0051591 A1 * 2/2018 Quennehen ..... F01D 11/005
2018/0087401 A1 * 3/2018 Quennehen ..... F01D 11/08
2018/0156069 A1 * 6/2018 Quennehen ..... F01D 11/08
2019/0128132 A1 * 5/2019 Tableau ..... F01D 25/005

FOREIGN PATENT DOCUMENTS

FR 2540939 A1 8/1984
FR 2955898 A1 8/2011
FR 3036435 A1 11/2016
GB 2480766 A 11/2011
WO 2006/136755 A2 12/2006
WO WO-2015047478 A2 * 4/2015 ..... F01D 11/18
WO WO-2015191174 A1 * 12/2015 ..... F01D 11/08
WO WO-2016146932 A1 * 9/2016 ..... F01D 25/246

* cited by examiner

TURBINE RING ASSEMBLY

CROSS-REFERENCE TO RELATED APPLICATION

This application claims priority to French Patent Application No. 1657826, filed Aug. 19, 2016, which is incorporated herein by reference in its entirety.

FIELD OF THE DISCLOSURE

The invention relates to a turbine ring assembly comprising a plurality of ring sectors made of ceramic matrix composite material and a ring support structure.

The field of application of the invention is in particular that of gas turbine aeronautical engines. The invention is however applicable to other turbomachines, for example industrial turbines.

INTRODUCTION

In the case of entirely metallic turbine ring assemblies, it is necessary to cool all the elements of the assembly and in particular the turbine ring which is subjected to the hottest flows. This cooling has a significant impact on the efficiency of the engine since the cooling flow used is taken from the main flow of the engine. Furthermore, the use of metal for the turbine ring limits the possibilities of increasing the temperature at the turbine level, which would however improve the efficiencies of the aeronautical engines.

In order to try to resolve these problems, producing turbine ring sectors in ceramic matrix composite (CMC) material has been considered in order to dispense with the implementation of a metal material.

The CMC materials exhibit good mechanical properties making them capable of forming structural elements and beneficially retain these properties at high temperatures. The implementation of CMC materials has beneficially made it possible to reduce the cooling flow to be imposed in operation and therefore to increase the efficiency of the turbomachines. Furthermore, the implementation of CMC materials beneficially makes it possible to reduce the weight of the turbomachines and reduce the hot expansion effect encountered with metal parts.

However, the existing solutions that are proposed can implement an assembly of a ring sector made of CMC with metal attachment parts of a ring support structure, these attachment parts being subjected to the hot flow. Consequently, these metal attachment parts undergo hot expansions, which can result in a mechanical stressing of the ring sectors made of CMC and an embrittlement thereof.

Also known are the documents FR 2 540 939, GB 2 480 766, EP 1 350 927, US 2014/0271145, US 2012/082540 and FR 2 955 898 which disclose turbine ring assemblies.

There is a need to improve the existing turbine ring assemblies implementing a CMC material in order to reduce the intensity of the mechanical stresses to which the ring sectors of CMC are subjected when the turbine is operating.

SUMMARY

An aspect of the invention seeks to propose a turbine ring assembly that makes it possible to hold each ring sector deterministically, that is to say in such a way as to control its position and avoid vibration thereof, on the one hand, while allowing the ring sector, and by extension of the ring, to deform under the effects of the temperature rises and pressure variations, and do so in particular independently of metal interface parts, and, on the other hand, while improving the seal between the out-of-stream sector and the stream sector and by simplifying the procedures by reducing the number thereof for mounting the ring assembly.

An embodiment of the invention provides a turbine ring assembly comprising a plurality of ring sectors made of ceramic matrix composite material forming a turbine ring and a ring support structure, each ring sector having, on a cutting plane defined by an axial direction and a radial direction of the turbine ring, a part forming an annular base with, in the radial direction of the turbine ring, an inside face defining the inside face of the turbine ring and an outside face from which extend a first and a second attachment tab, the ring support structure comprising a first and a second radial tab between which are held the first and second attachment tabs of each ring sector, and the ring assembly comprising, for each ring sector, at least three pins for holding the ring sector in position, at least two of the pins cooperating with one of the first radially or second attachment tabs of the ring sector and the first or second corresponding radial tab of the ring support structure, and at least one of the pins cooperating with the other attachment tab of the ring sector and the corresponding radial tab of the ring support structure.

According to a general feature of the subject, the first radial tab comprises a first annular radial portion integral to the ring support structure, a removable second annular radial portion extending radially toward the center of the turbine ring over a greater portion than the first annular radial portion, the portion extending beyond the first annular radial portion including orifices for receiving a pin.

The removable nature of the second annular radial portion of the first radial tab relative to the first annular radial portion integral to the ring support structure makes it possible to have axial access to the cavity of the turbine ring. That makes it possible to assemble the ring sectors together outside the ring support structure and then axially slide the duly assembled assembly into the cavity of the ring support structure until it comes to bear against the second annular radial tab, before fixing the second annular radial portion to the first annular radial portion.

In the operation to fix the turbine ring onto the ring support structure, it is possible to use a tool including a cylinder or a ring onto which the ring sectors are pressed or suckered during the annulus assembly thereof.

The solution defined above for the ring assembly thus makes it possible to hold each ring sector deterministically, that is to say control its position and avoid vibration thereof, while improving the seal between the out-of-stream sector and the stream sector, by simplifying the procedures and by reducing the number thereof for mounting the ring assembly, and by allowing the ring to deform under the effects of temperature and pressure, in particular independently of the interface metal parts.

According to a first aspect of the turbine ring assembly, the removable second annular radial portion comprises a first annular flange comprising a first portion bearing against the first attachment tab of the ring, a second portion fixed removably to the first annular radial portion, and a third portion positioned between the first and second portions and including orifices for receiving a pin, the first portion and the third portion of the first annular flange extending beyond the first annular radial portion of the first radial tab.

Given that the first portion and the third portion of the first annular flange extend beyond the first annular radial portion of the first radial tab, the space remaining free when the flange is removed allows an axial introduction of the ring into the ring support structure.

According to a second aspect of the turbine ring assembly, the first annular flange is an annular flange made of a single piece.

The fact of having a annular flange made of a single piece, that is to say describing all of the ring over 360°, makes it possible, compared to a sectored annular flange, to limit the passage of the flow of air between the out-of-stream sector and the stream sector, in as much as all the inter-sector leaks are eliminated, and therefore to control the seal-tightness.

According to a third aspect of the turbine ring assembly, the first and second attachment tabs of each ring sector each comprise a first end integral to the outside face of the annular base, a free second end, at least one lug for receiving a pin, each lug extending protrudingly from the second end of one of the first or second attachment tabs in the radial direction of the turbine ring, each reception lug including an orifice for receiving a pin.

The lugs produced radially protruding from the free ends of the first and second attachment tabs make it possible to distance the zone holding the attachment tabs from the bearing zones included between the two ends of the attachment tabs and intended to produce a tight contact, on the one hand, with the first portion of the first annular flange and, on the other hand, with the second radial tab of the ring support structure.

According to a fourth aspect of the turbine ring assembly, the second tab of the ring support structure comprises an annular collar comprising a first portion bearing against the second attachment tab, a second portion that is thinned relative to the first portion, and a third portion positioned between the first and the second portion and including orifices for receiving a pin.

The reduction of the thickness of the second portion of the annular collar, that is to say the downstream collar, makes it possible to provide the secondary collar with flexibility and thus not excessively stress the ceramic matrix composite material of the ring sector.

It is possible also to produce an axial prestressing of the second annular collar by making an interference of a few tenths of millimeters. This makes it possible to take up the expansion differences between the ceramic matrix composite material elements and the metal elements.

Furthermore, separating the zone receiving the pins and the zones of bearing of the attachment tabs of the ring against the annular flange, on the one hand, and against the annular collar, on the other hand, makes it possible to optimize the seal-tightness by reducing the breaks in the bearing zone.

According to a fifth aspect of the turbine ring assembly, each ring sector comprises rectilinear bearing surfaces mounted on the faces of the first and second attachment tabs in contact respectively with the annular collar and the first annular flange.

The rectilinear bearings make it possible to have zones of controlled seal-tightness because a bearing over a continuous line makes it possible not to have leaks. More specifically, having bearings on radial planes makes it possible to dispense with the straightening effects in the turbine ring. This alignment of the contact zones on parallel rectilinear planes in effect makes it possible to conserve sealing lines in case of tilting of the ring and conserve the same contact zones both when cold and when hot.

In operation, the ring sectors tilt about an axis corresponding to the normal to the plane formed between the axial direction and the radial direction of the turbine ring. In the case of a curvilinear bearing, as in the prior art, the tabs of the ring sectors are in contact with the ring support structure on one or two points only whereas, in the present invention, the rectilinear bearings of the tabs of each ring sector allow a bearing over an entire line, which improves the seal-tightness between the ring sectors and the ring support structure.

In a variant, for each ring sector, the faces of the annular collar and of the first annular flange in contact respectively with the first and second attachment tabs comprise rectilinear bearing surfaces.

In an aspect of this variant, each rectilinear bearing surface can comprise a groove hollowed out over all the length of the bearing surface and a seal inserted into the groove to improve the seal-tightness.

According to a sixth aspect of the turbine ring assembly, the first radial tab of the ring support structure further comprises a second annular flange comprising a first portion and a second portion, the second portion being coupled to the first annular radial portion and to the second portion of the first annular flange, the first portion of the second annular flange being at a distance in the axial direction of the turbine ring, from the first portion of the first annular flange.

The second annular flange is dedicated to taking up the load from the high-pressure distributor, also denoted DHP. This annular flange makes it possible to take up this load, on the one hand, by deforming, and, on the other hand, by passing on this load to the case in line which is the most mechanically robust.

In effect, leaving a space between the first portion of the second annular flange and the first portion of the first annular flange makes it possible to divert the load received by the second annular flange, upstream of the first annular flange relative to the direction of the gas flow, and pass it directly to the central annulus of the ring support structure via the second portion of the second annular flange, without affecting the first portion of the first annular flange bearing against the first attachment tab of the ring. Since the first portion of the first annular flange is not subject to load, the turbine ring is thus preserved from this axial load.

According to a seventh aspect of the turbine ring assembly, the ring assembly can further comprise, for each ring sector, at least one fixing screw passing through the first and second annular flanges and the first annular radial portion, and at least one fixing nut cooperating with the at least one fixing screw to fix the first and second annular flanges to the first annular radial portion.

Another aspect of the invention provides a turbomachine comprising a turbine ring assembly as defined above.

BRIEF DESCRIPTION OF THE DRAWINGS

The invention will be better understood on reading the following description, given in an indicative but nonlimiting manner, with reference to the attached drawings in which.

DETAILED DESCRIPTION

Figure 1:
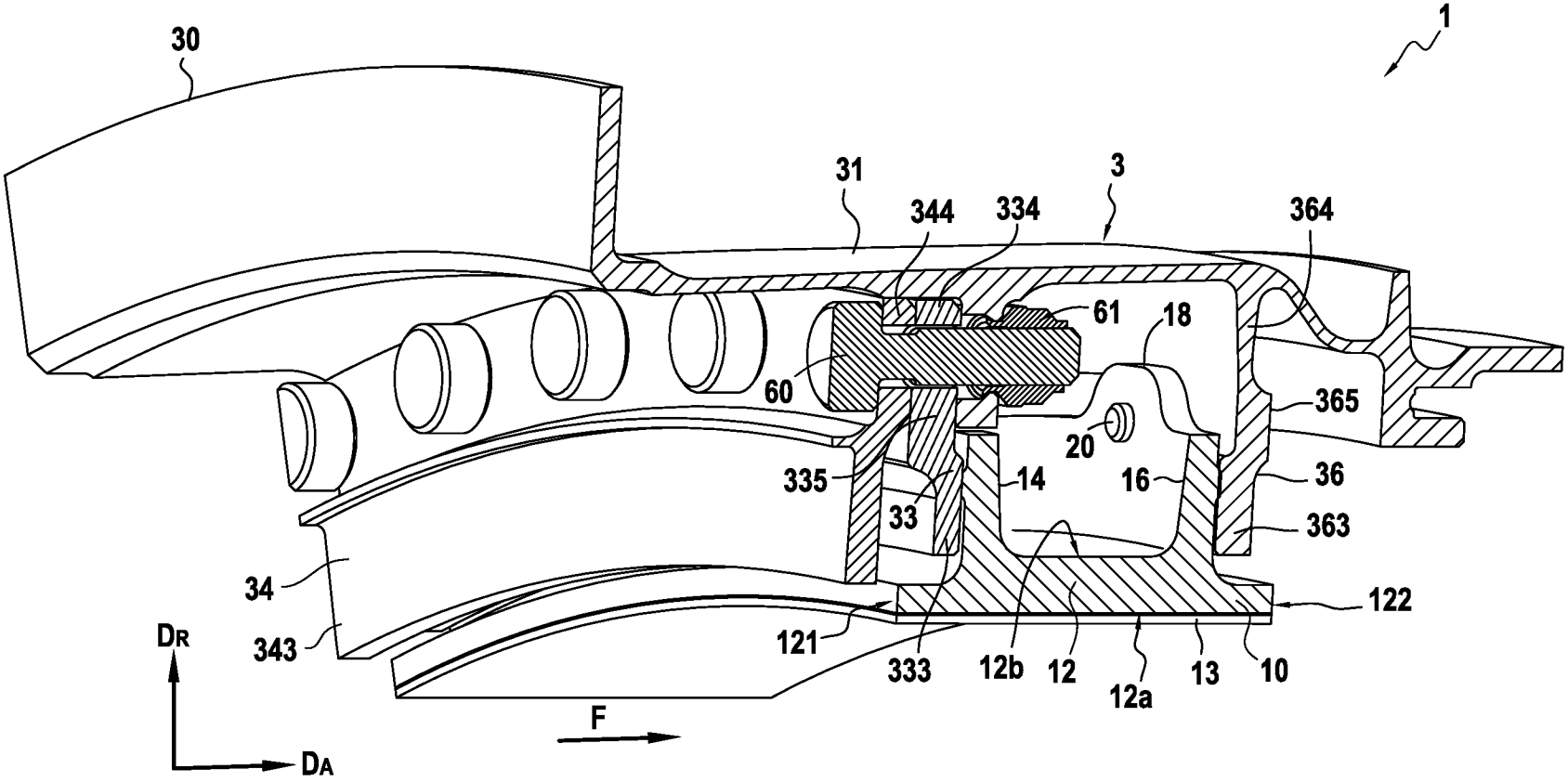
FIG. 1 is a first perspective schematic view of an embodiment of a turbine ring assembly according to the invention.

FIG. 1 shows a high-pressure turbine ring assembly comprising a turbine ring 1 made of ceramic matrix composite (CMC) material and a metal ring support structure 3. The turbine ring 1 surrounds a set of rotary blades (not represented). The turbine ring 1 is formed by a plurality of ring sectors 10, FIG. 1 being a view in radial section. The arrow $D_A$ indicates the axial direction of the turbine ring 1 whereas the arrow $D_R$ indicates the radial direction of the turbine ring 1. For the purposes of simplifying presentation, FIG. 1 is a partial view of the turbine ring 1 which is in fact a complete ring.

Figure 2:
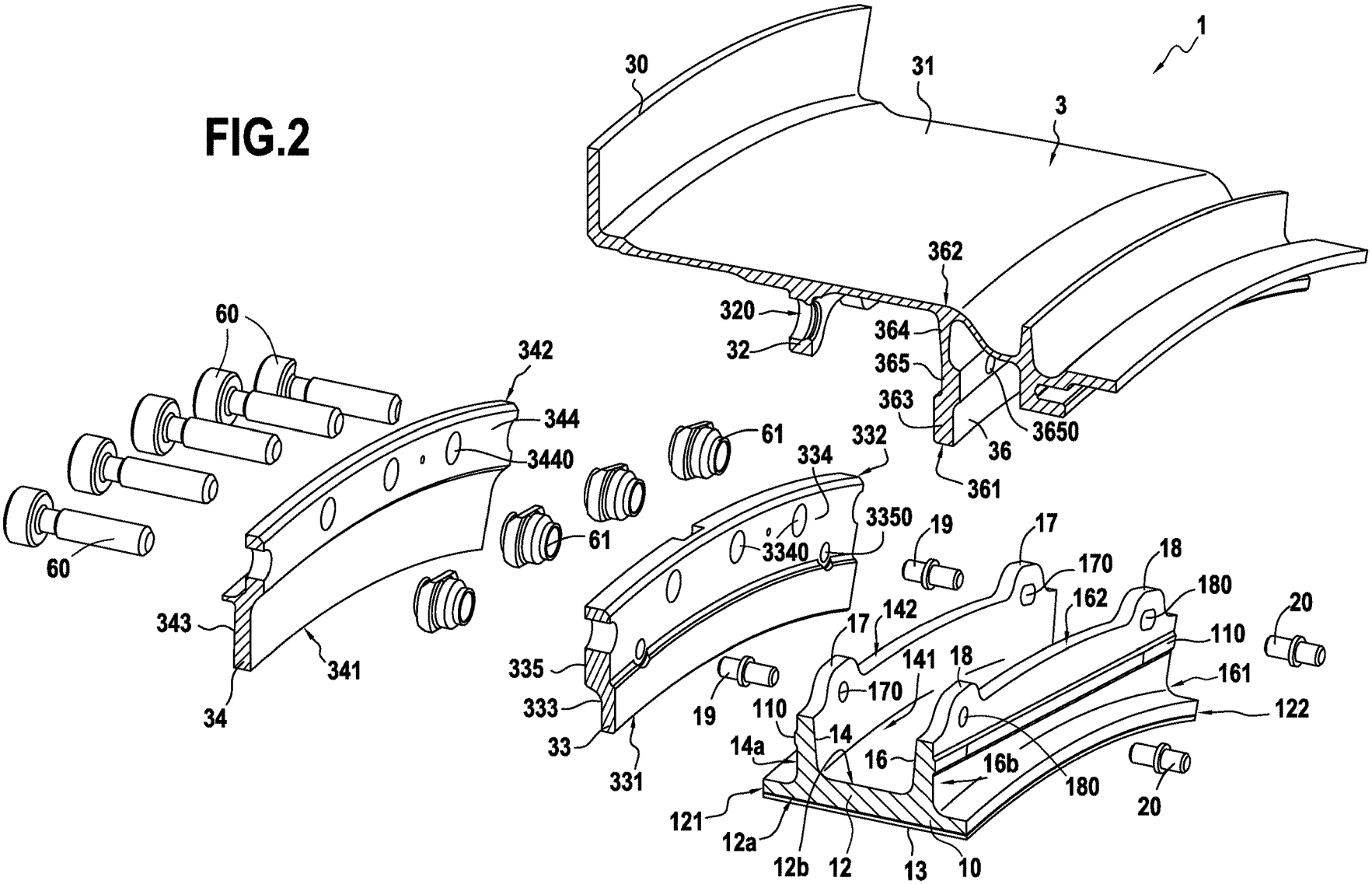
FIG. 2 is a first exploded perspective schematic view of the turbine ring assembly of FIG. 1.

As illustrated in FIG. 2 which shows an exploded perspective schematic view of the turbine ring assembly of FIG. 1, each ring sector 10 has, on a plane defined by the axial $D_A$ and radial $D_R$ directions, a section roughly in the form of an inverted π. The section in fact comprises an annular base 12 and upstream and downstream radial attachment tabs 14 and 16. The terms "upstream" and "downstream" are used here with reference to the direction of flow of the gaseous flow in the turbine represented by the arrow F in FIG. 1. The tabs of the ring sector 10 could have another form, the section of the ring sector having a form other than π, such as, for example, in the form of a k.

The annular base 12 comprises, in the radial direction $D_R$ of the ring 1, an inside face 12*a* and an outside face 12*b* opposite one another. The inside face 12*a* of the annular base 12 is coated with a layer 13 of a braidable material forming a thermal and environmental barrier and defines a stream of flow of gaseous flows in the turbine.

The upstream and downstream radial attachment tabs 14 and 16 extend protrudingly, in the direction $D_R$, from the outside face 12*b* of the annular base 12 at a distance from the upstream and downstream ends 121 and 122 of the annular base 12. The upstream and downstream radial attachment tabs 14 and 16 extend over all the width of the ring sector 10, that is to say over all of the circular arc described by the ring sector 10, or even over all the circumferential length of the ring sector 10.

As is illustrated in FIGS. 1 and 2, the ring support structure 3 which is integral to a turbine casing 30 comprises a central annulus 31, extending in the axial direction $D_A$, and having an axis of revolution coinciding with the axis of revolution of the turbine ring 1 when they are fixed together. The ring support structure 3 further comprises an upstream annular radial collar 32 and a downstream annular radial collar 36 which extend, in the radial direction $D_R$, from the central annulus 31 to the center of the ring 1 and in the circumferential direction of the ring 1.

As is illustrated in FIGS. 1 and 2, the downstream annular radial collar 36 comprises a first free end 361 and a second end 362 integral to the central annulus 31. The downstream annular radial collar 36 comprises a first portion 363, a second portion 364, and a third portion 365 included between the first portion 363 and the second portion 364. The first portion 363 extends between the first end 361 and the third portion 365, and the second portion 364 extends between the third portion 365 and the second end 362. The first portion 363 of the annular radial collar 36 is in contact with the downstream radial attachment tab 16. The second portion 364 is thinned with respect to the first portion 363 and the third portion 365 to give the annular radial collar 36 a certain flexibility and thus not excessively stress the turbine ring 1 made of CMC.

Figure 4:
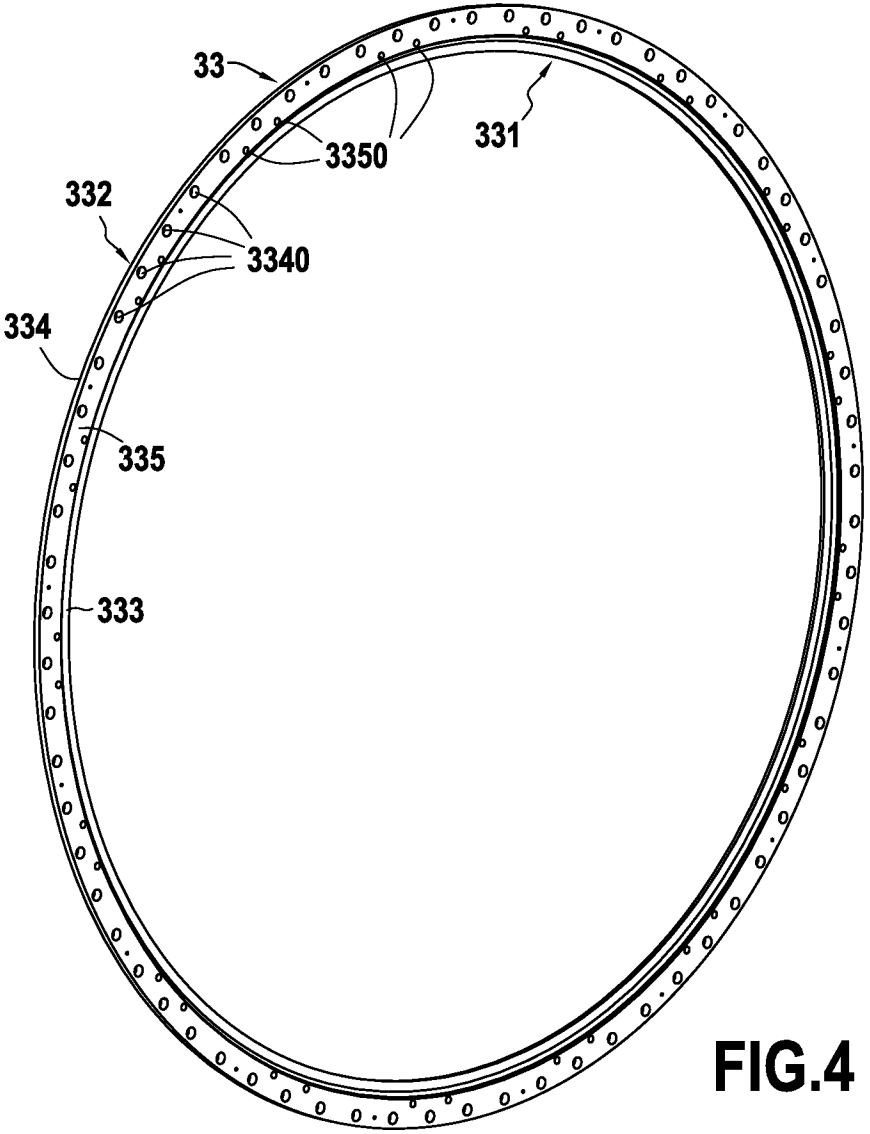
FIG. 4 is a third perspective schematic view of the first flange upstream of the turbine ring assembly of FIG. 1.
Figure 3:
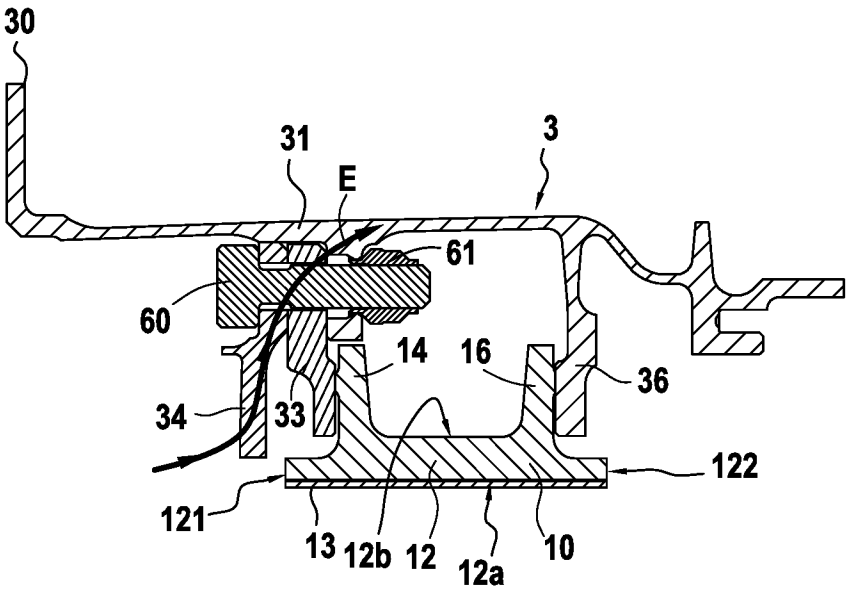
FIG. 3 is a second schematic view in cross section of the turbine ring assembly of FIG. 1.

As is illustrated in FIGS. 1 and 2, and in FIG. 3 which presents a cross-sectional view of the turbine ring assembly of FIG. 1 on a plane comprising the axial direction $D_A$ of the turbine ring 1 and the radial direction $D_R$ of the turbine ring 1, the ring support structure 3 further comprises a first and a second upstream flanges 33 and 34 each, in this embodiment, being in the form of a ring, the two upstream flanges 33 and 34 being fixed together on the upstream annular radial collar 32. FIG. 4 shows a perspective view of the first upstream flange 33 produced in a single annular piece. In a variant, the first and second upstream flanges 33 and 34 could be sectored into a plurality of ring sectors.

The first upstream flange 33 comprises a first free end 331 and a second end 332 in contact with the central annulus 31. The first upstream flange 33 further comprises a first portion 333 extending from the first end 331, a second portion 334 extending from the second end 332, and a third portion 335 extending between the first portion 333 and the second portion 334.

The second upstream flange 34 comprises a first free end 341 and a second end 342 in contact with the central annulus 31, and a first portion 343 sand a second portion 344, the first portion 343 extending between the first end 341 and the second portion 344, and the second portion 344 extending between the first portion 343 and the second end 342.

The first portion 333 of the first upstream flange 33 bears on the upstream radial attachment tab 14 of the ring sector 10. The first and second upstream flanges 33 and 34 are conformed to have the first portions 333 and 343 at a distance from one another and the second portions 334 and 344 in contact, the two flanges 33 and 34 being fixed removably to the upstream annular radial collar 32 using fixing screws 60 and nuts 61, the screws 60 passing through the orifices 3340, 3440 and 320 provided respectively in the second portions 334 and 344 of the two upstream flanges 33 and 34 and in the upstream annular radial collar 32.

The second upstream flange 34 is dedicated to taking up the load of the high-pressure distributor (DHP), on the one hand, by distorting, and, on the other hand, by passing this load to the casing line which is more mechanically robust, that it say to the line of the ring support structure 3 as is illustrated by the load arrows E presented in FIG. 3.

In the axial direction $D_A$, the downstream annular radial collar 36 of the ring support structure 3 is separated from the first upstream flange 33 by a distance corresponding to the separation upstream and downstream radial attachment tabs 14 and 16 so as to hold the latter between the downstream annular radial collar 36 and the first upstream flange 33.

To hold the ring sectors 10, and therefore the turbine ring 1, in position with the ring support structure 3, the ring assembly comprises two first pins 19 cooperating with the upstream attachment tab 14 and the first upstream flange 33, and two second pins 20 cooperating with the downstream attachment tab 16 and the downstream annular radial collar 36.

For each corresponding ring sector 10, the third portion 335 of the first upstream flange 33 includes two orifices 3350 for receiving two first pins 19, and the third portion 365 of the annular radial collar 36 includes two orifices 3650 configured to receive the two second pins 20.

For each ring sector 10, each of the upstream and downstream radial attachment tabs 14 and 16 comprises a first end, 141 and 161, integral to the outside face 12*b* of the annular base 12, and a free second end, 142 and 162. The second end 142 of the upstream radial attachment tab 14 comprises two first lugs 17 each including an orifice 170 configured to receive a first pin 19. Similarly, the second end 162 of the downstream radial attachment tab 16 comprises two second lugs 18 each including an orifice 180 configured to receive a second pin 20. The first and second lugs 17 and 18 extend protrudingly in the radial direction $D_R$ of the turbine ring 1, respectively from the second end 142 of the upstream radial attachment tab 14 and from the second end 162 of the downstream radial attachment tab 16.

For each ring sector 10, the two first lugs 17 are positioned at two different angular positions relative to the axis of revolution of the turbine ring 1. Similarly, for each ring sector 10, the two second lugs 18 are positioned at two different angular positions relative to the axis of revolution of the turbine ring 1.

Each ring sector 10 further comprises rectilinear bearing surfaces 110 mounted on the faces of the upstream and downstream radial attachment tabs 14 and 16 in contact respectively with the first upstream annular flange 33 and the downstream annular radial collar 36, that is to say on the upstream face 14*a* of the upstream radial attachment tab 14 and on the downstream face 16*b* of the downstream radial attachment tab 16. In a variant, the rectilinear bearings could be mounted on the first upstream annular flange 33 and on the downstream annular radial collar 36.

The rectilinear bearings 110 make it possible to have zones of controlled seal-tightness. In effect, the bearing surfaces 110 between the upstream radial attachment tab 14 and the first upstream annular flange 33, on the one hand, and between the downstream radial attachment tab 16 and the downstream annular radial collar 36 are included in one and the same rectilinear plane.

More specifically, having bearings on radial planes makes it possible to dispense with straightening effects in the turbine ring 1.

There now follows a description of a method for producing a turbine ring assembly corresponding to that represented in FIG. 1.

Each ring sector 10 described above is produced in ceramic matrix composite (CMC) material by forming a fiber preform having a form approximating that of the ring sector and compregnating the ring sector by a ceramic matrix.

To produce the fiber preform, it is possible to use ceramic fiber threads, for example SiC fiber threads such as those marketed by the Japanese company Nippon Carbon under the name "Hi-NicalonS", or carbon fiber threads.

The fiber preform is beneficially produced by three-dimensional weaving, or multilayer weaving, with the formation of non-interlinking zones making it possible to separate the parts of preforms corresponding to the tabs 14 and 16 of the sectors 10.

The weaving can be of interlock type. Other three-dimensional or multilayer weaves can be used, such as, for example, multiple-web or multiple-satin weaves. Reference will be able to be made to the document WO 2006/136755.

After weaving, the blank can be shaped to obtain a ring sector preform which is consolidated and compregnated by a ceramic matrix, the compregnation being able to be done in particular by chemical vapor infiltration (CVI) which is well known per se. In a variant, the fabric preform can be hardened a little by CVI for it to be rigid enough to be handled, before making liquid silicon rise by capillarity into the fabric to do the compregnation ("Melt Infiltration").

A detailed example of the production of ring sectors in CMC is in particular described in the document US 2012/0027572.

For its part, the ring support structure 3 is produced in a metal material such as a Waspaloy® or inconel 718® or even C263® alloy.

The production of the turbine ring assembly is continued by the mounting of the ring sectors 10 onto the ring support structure 3.

For that, the ring sectors 10 are assembled together on an annular tool of "spider" type comprising, for example, suckers, each configured to hold a ring sector 10. The assembly of the ring sectors 10 is performed by inserting inter sector sealing tongues between each pair of ring sectors.

Then, the two second pins 20 are inserted into the two orifices 3650 provided in the third portion 365 of the annular radial collar 36 of the ring support structure 3.

The ring 1 is then mounted on the ring support structure 3 by inserting each second pin 20 into each of the orifices 180 of the second lugs 18 of the downstream radial attachment tabs 16 of each ring sector 10 forming the ring 1.

The orifices 170 and 180 can be circular or oblong. Preferably, the set of orifices 170 and 180 comprises one portion of circular orifices and one portion of oblong orifices. The circular orifices make it possible to tangentially index the rings and prevent them from being able to be displaced tangentially (notably if touched by the blade). The oblong orifices make it possible to accommodate the differential expansions between the CMC and the metal. CMC has an expansion coefficient very much lower than that of metal. When hot, the lengths in the tangential direction of the ring sector and of the facing portion of casing will therefore be different. If there were only circular orifices, the metal casing would impose its displacement on the CMC ring, which would be the source of very high mechanical stresses in the ring sector. Having oblong holes in the ring assembly allows the pin to slide in this hole and avoid the abovementioned overstressing phenomenon. Consequently, it is possible to imagine two drilling schemes: a first drilling scheme, for a case with three lugs, would comprise one radial oblong orifice on a radial attachment tab and two tangential oblong orifices on the other radial attachment tab, and a second drilling scheme, for a case with at least four lugs, would comprise one circular orifice and one oblong orifice for each facing radial attachment tab each time. Other ancillary cases can also be envisaged.

The annular tool is then removed and all the first pins 19 are placed in the orifices 3350 provided in the third portion 335 of the first upstream flange 33, and the first upstream flange 33 is mounted onto the ring assembly engaging the first pins 19 in the orifices 170 of the first lugs of the upstream attachment tab 14 until the first portion 333 of the first upstream flange 33 is bearing against the bearing surface 110 of the upstream face 14*a* of the upstream attachment tab 14 of the ring 1 and the second portion 334 of the first upstream flange 33 is bearing against the upstream annular radial collar 32.

The second upstream flange 34 is then arranged on the turbine ring assembly by pressing the second portion 344 of the second upstream flange 34 against the second portion 334 of the first upstream flange 33.

To fix the two upstream flanges 33 and 34 together to the ring support structure 3, screws 60 are inserted into the coaxial orifices 3440, 3340 and 320 provided in the second portion 344 of the second upstream flange 34, in the second portion 334 of the first flange and in the upstream annular radial collar 32, and each of the screws 60 is tightened using a nut 61.

The ring 1 is then held in positon axially using the first upstream flange 33 and the annular radial collar 36 bearing respectively upstream and downstream on the rectilinear bearing surfaces 110 of the respectively upstream 14 and downstream 16 radial attachment tabs. Also, the ring 1 is held in position radially using first and second pins 19 and 20 cooperating with the first and second lugs 17 and 18 and the orifices 3350 and 3650 of the first upstream flange 33 and of the annular radial collar 36.

The invention also provides a turbine ring assembly that makes it possible to hold each ring sector deterministically while allowing, on the one hand, the ring sector, and by extension of the ring, to be deformed under the effects of temperature rises and pressure variations, and to do so in particular, independently of the metal interface parts, and, on the other hand, while improving the seal-tightness between the out-of-stream sector and the stream sector and by simplifying the procedures and by reducing the number thereof for mounting the ring assembly.

We claim:

1. A turbine ring assembly comprising:

a plurality of ring sectors made of ceramic matrix composite material and forming a turbine ring, and a ring support structure, each ring sector having, on a cutting plane defined by an axial direction and a radial direction of the turbine ring, a portion forming an annular base with, in the radial direction of the turbine ring, a radially inside face of the annular base defining a radially inside face of the turbine ring, and an outside face from which extend a first and a second attachment tab, the ring support structure including a first and a second radial tab between which are held the first and second attachment tabs of each ring sector, the turbine ring assembly including, for each ring sector, at least three pins for holding the ring sector radially in position, at least two of the pins cooperating with one of the first or second attachment tabs of the ring sector and the first or second corresponding radial tab of the ring support structure, and at least one of the pins cooperating with the other attachment tab of the ring sector and the other corresponding radial tab of the ring support structure, wherein the first radial tab includes:

an upstream annular radial collar integral to the ring support structure, a removable first upstream flange extending radially toward the center of the turbine ring over a greater distance than said upstream annular radial collar, the first upstream flange extending beyond the upstream annular radial collar and including orifices for receiving one of the pins, the first upstream flange including:

a first portion bearing against the first attachment tab, a second portion fixed removably to the upstream annular radial collar, and a third portion positioned between the first and the second portions and including orifices for receiving one of the pins, the third portion and the first portion of the first upstream flange extending beyond the upstream annular radial collar.

2. The assembly as claimed in claim 1, in which said upstream annular radial collar forms an annular flange made of a single piece.

3. The assembly as claimed in claim 1, in which the first and second attachment tabs of each ring sector each comprise a first end integral to the outside face of the annular base, a free second end, at least one lug for receiving one of the pins, each lug extending protrudingly from the second end of one of the first or second attachment tabs in the radial direction of the turbine ring, each reception lug including an orifice for receiving one of the pins.

4. The assembly as claimed in claim 1, in which the second radial tab of the ring support structure comprises a downstream annular radial collar comprising a first portion bearing against the second attachment tab, a second portion that is thinned relative to the first portion, and a third portion positioned between the first and second portions and including orifices for receiving one of the pins.

5. The assembly as claimed in claim 4, in which each ring sector comprises rectilinear bearing surfaces mounted on the faces of the first and second attachment tabs in contact respectively with the downstream annular radial collar and the first upstream flange.

6. The assembly as claimed in claim 4, in which, for each ring sector, the faces of the downstream annular radial collar and of the first upstream flange in contact respectively with the first and second attachment tabs comprise rectilinear bearing surfaces.

7. The assembly as claimed in claim 2, in which the first radial tab of the ring support structure further comprises a second upstream flange comprising a first portion and a second portion, the second portion being coupled to the upstream annular radial collar and to the second portion of the first upstream flange, the first portion of the second upstream flange being at a distance, in the radial direction of the turbine ring, from the first portion of the first upstream flange.

8. The assembly as claimed in claim 7, comprising, for each ring sector, at least one fixing screw passing through the first and second upstream flanges and the upstream annular radial collar, and at least one fixing nut cooperating with said at least one fixing screw to fix the first and second upstream flanges to the upstream annular radial collar.

9. A turbomachine comprising:

a turbine ring assembly including:

a plurality of ring sectors made of ceramic matrix composite material and forming a turbine ring, and a ring support structure, each ring sector having, on a cutting plane defined by an axial direction and a radial direction of the turbine ring, a portion forming an annular base with, in the radial direction of the turbine ring, a radially inside face of the annular base defining a radially inside face of the turbine ring, and an outside face from which extend a first and a second attachment tab, the ring support structure including a first and a second radial tab between which are held the first and second attachment tabs of each ring sector, the turbine ring assembly including, for each ring sector, at least three pins for radially holding the ring sector in position, at least two of the pins cooperating with one of the first or second attachment tabs of the ring sector and the first or second corresponding radial tab of the ring support structure, and at least one of the pins cooperating with the other attachment tab of the ring sector and the other corresponding radial tab of the ring support structure, wherein the first radial tab includes:

an upstream annular radial collar integral to the ring support structure, a removable first upstream flange extending radially toward the center of the turbine ring over a greater distance than said upstream annular radial collar, the first upstream flange extending beyond the upstream annular radial collar and including orifices for receiving one of the pins, the first upstream flange including:

a first portion bearing against the first attachment tab, a second portion fixed removably to the upstream annular radial collar, and a third portion positioned between the first and the second portions and including orifices for receiving one of the pins, the third portion and the first portion of the first upstream flange extending beyond the upstream annular radial collar.

* * * * *